United States Patent [19]

Maingueneau

[11] Patent Number: 4,898,220

[45] Date of Patent: Feb. 6, 1990

[54] CONICAL SCREW AUGER MACHINE FOR SPLITTING A LOG OF WOOD

[75] Inventor: Gérard Maingueneau, Les Trois-Moutiers, France

[73] Assignee: Mecanique des 3 Moutiers, France

[21] Appl. No.: 334,782

[22] Filed: Apr. 6, 1989

Related U.S. Application Data

[63] Continuation of Ser. No. 190,758, May 6, 1988, abandoned.

[51] Int. Cl.[4] ..... B27L 7/00

[52] U.S. Cl. ..... 144/194; 144/193 R; 144/366

[58] Field of Search ..... 144/366

[56] References Cited

U.S. PATENT DOCUMENTS

| | | | |
|---|---|---|---|
| 3,670,789 | 6/1972 | Long | 144/194 |
| 4,188,987 | 2/1980 | James | 144/194 |
| 4,245,683 | 1/1981 | Cedergren | 144/194 |
| 4,553,576 | 11/1985 | Maingueneau . | |

FOREIGN PATENT DOCUMENTS

| | | | |
|---|---|---|---|
| 021944 | 4/1987 | European Pat. Off. . | |
| 1453288 | 7/1969 | Fed. Rep. of Germany . | |
| 22245 | 1/1948 | Finland | 144/194 |
| 2500358 | 8/1982 | France | 144/194 |
| 304465 | 1/1955 | Switzerland | 144/194 |

*Primary Examiner*—W. Donald Bray

*Attorney, Agent, or Firm*—Laff, Whitesel, Conte & Saret

[57] ABSTRACT

The wood splitting machine comprised of a rotating threaded cone, a longitudinal wedge disposed under the cone, and a table on top of which the log to be split is placed in front of the cone and wedge. The table top is rigid and the wedge is firmly fixed both to the rigid table top and to the bearing of the rotating shaft of the rotating threaded cone. The rigid top comprises a plywood plate whose upper side is covered with sheet metal. A speed reducer is provided between the drive motor and the rotating shaft of the threaded cone; the speed reducer is comprised of an intermediary pinion whose bearing is also fixed to the wedge. The upper profile of the wedge has the same shape as the generator of the rotating threaded cone up to a short distance from the point thereof.

5 Claims, 1 Drawing Sheet

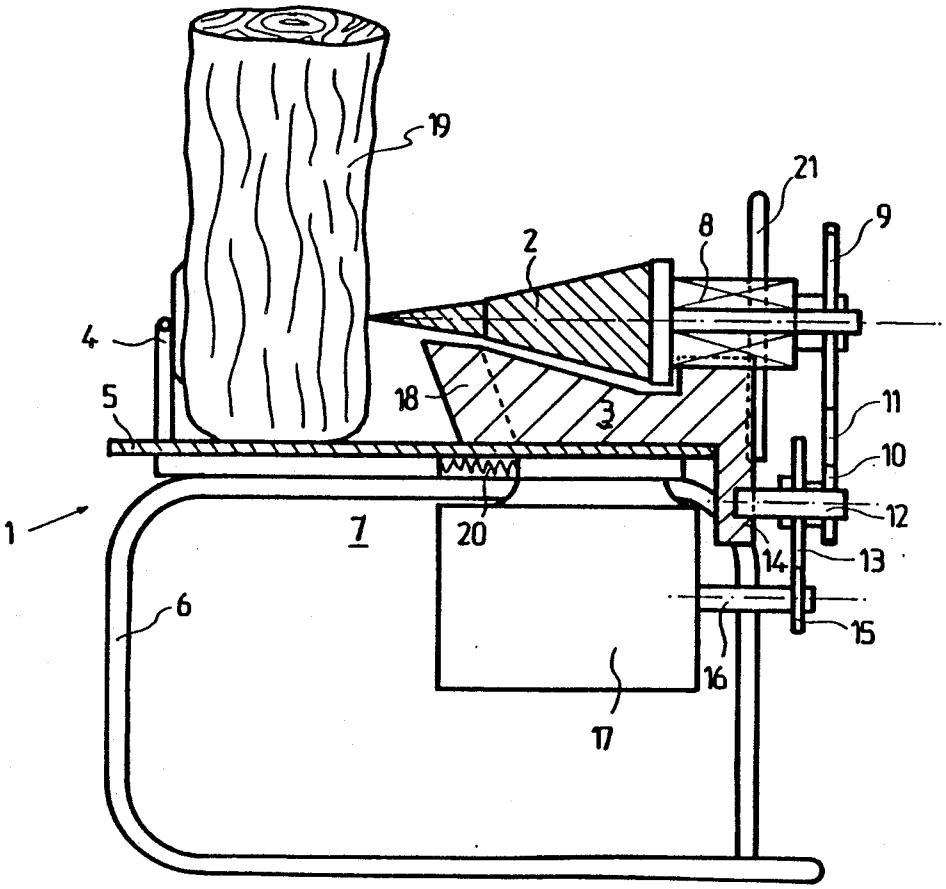
1
2
3
4
5
6
7
8
9
10
11
12
13
14
15
16
17
18
19
20
21

CONICAL SCREW AUGER MACHINE FOR SPLITTING A LOG OF WOOD

This application is a continuation of application Serial No. 07/190,758, filed May 6, 1988, abandoned.

The present invention relates to a wood splitting machine comprising a rotating threaded cone, a longitudinal wedge disposed under said cone, and a table on the top of which the log to be split is placed in front of the cone and wedge.

By way of information, the document EP-A-0 219 444 describes a wood splitting machine comprised of a rotating threaded cone with a horizontal axis of rotation turning above a table and provided with a protective device for the point of the cone. The document DE-A-1 453 288 also describes a wood splitting machine comprising a rotating threaded cone, a wedge and a table. The wedge is mounted on a spring fastened under the table and can eventually retract in a hole cut in the table. The wedge prevents the rotation of the log to be split about the axis of rotation of the cone.

Thus, in the first cited document, only the proper placement of the log on the table prevents its rotation, whereas, in the second document, one uses a wedge fastened to the table by means of a spring. The present invention is an improvement to the invention described in the second document. Nevertheless, experience has proven that the presence of a link as flexible as the spring between the wedge and the table results in the wedge being able to retract completely into the table hole to the point of no longer being able to prevent dangerous rotation of the log to be split. The descent of the wedge into the table could be promoted by vibrations.

An object of the invention is to provide a wood splitting machine which solves these inconveniences and, in particular, which ensures that the log cannot turn.

Another object of the invention is to provide a splitting machine in which the vibrations are appreciably reduced.

According to one embodiment of the invention, the table top is rigid and the wedge is firmly fastened both to the rigid table top and to the rotating shaft bearing of the rotating threaded cone.

According to another embodiment, the rigid top is comprised of a plywood plate whose upper side is covered with sheet metal.

According to another embodiment, a speed reducer is provided between the drive motor and the rotating shaft of the threaded cone, the speed reducer being comprised of an intermediary pinion whose bearing is also fixed to said wedge.

According to another embodiment, the upper profile of the wedge has the same shape as the generator of the rotating threaded cone, up to a short distance from the point thereof.

According to another embodiment, the motor is an electric motor fastened under said table top.

The above-noted embodiments of the invention, as well as others, will become clearer on reading the following description of a preferred embodiment of the invention, the description being made with reference to the one attached drawing.

The structure shown in the only drawing includes a table 1, a rotating threaded cone 2, a wedge 3 and a protective device 4.

The table consists of a top 5 mounted on a frame formed of posts 6 and tubular longerons 7, which are joined in an appropriate manner. In the illustrated embodiment, the frame 6 and the longerons 7 are assembled to form two lateral bodies on each side of the table, three corners of the two bodies being in the form of tubular elbows so as to ensure a good rigidity and so that the table could be shifted like a sled. The table top 5 is comprised of a plywood plate whose upper side is covered in sheet metal.

The plywood provides the plate with excellent rigidity and, moreover, by means of suitable angle irons, a good means of fastening to the frame. The sheet metal covering permits the base of the log to be split to slide easily on the table.

The rotating threaded cone 2 has its shaft supported by a bearing 8 and is driven by a pinion 9, itself driven by a pinion 10, by means of a chain 11. Pinion 10 is mounted on a shaft 12, parallel to the shaft of cone 2 and on which another pinion 13 is mounted. Shaft 12 is supported by a bearing 14, which is firmly fastened under the table top 5. Pinion 13 engages a last pinion 15 which is mounted on shaft 16 of an electric motor 17 fastened under the table top 5.

Wedge 3 is a steel piece whose front part 18 has the shape of a dihedron and whose profile follows the shape of the cone generator 2. The base of wedge 3 is welded to the sheet metal of table top 5. The upper part of the wedge is, behind cone 2, welded to the lower part of bearing 8. In the illustrated embodiment, the lower rear part of wedge 3 is extended downward, through top 5, to form a support in which bearing 14 of shaft 12 is lodged. Thus, it becomes apparent that wedge 3, independent of its role as wedge, establishes a rigid link between bearing 8, top 5 and bearing 14.

The result of this is that there are no deformations between those elements 8, 3, 5 and 14. Any gap between the axis of the threaded cone and the table top can, therefore, not occur, which is important because, when one splits a log by means of a threaded cone, the log has the tendency to turn. The table prevents this, but can itself undergo a deformation. The wedge, plus the plywood plate of the top, prevents such possible deformations.

The fact of having fastened the motor 17 under the non-deformable top forces the shaft 16 of motor 17 to maintain a constant position relative to the table and, thus, in relation to the shaft of the rotating threaded cone 2. The result of this is that the speed reducer, formed by the pinions 9, 10, 13 and 15, works in line and the loses due to friction are reduced to a minimum. Another driving means can be used instead of the electric motor 17.

It should be noted that the wedge 3 improves the security of the machine, because, in the case of logs having a small diameter, it completely avoids the rotation of the log.

In practice, the part formed by wedge 3 and bearing 14 can be a single part which comes directly from a foundry.

The machine illustrated in the one drawing is, moreover, supplemented by a security device 4 which is drawn by springs 20 in a manner so as to push the log 21 toward the point of the rotating threaded cone and to cover this point once the splitting has been carried out. The security device can be of the type which is described in document EP-A-0 219 444.

Behind the machine, above top 5, a plate 21 protects bearing 8 and serves to support a housing, which is not shown, which covers the pinions 9, 10, 13 and 15.

I claim:

1. A wood splitting machine comprising a table having a metal surface for receiving a log which is to be split, a rotating threaded cone having a central axis of rotation which is parallel to the surface of said table, bearing means at the base of the cone for rotatably supporting said threaded cone, drive means for applying a rotational driving force through said bearing to turn said threaded cone, and a splitting wedge comprising a metal plate ahving a forward blade for penetrating and splitting a log, said plate having an elongation which lies along said axis of rotation, a bottom edge of said plate being fixed along its entire length to said surface of said table, a back portion of said plate being fixed to said bearing means for supporting said threaded cone, said back portion further having a member fixed to said drive means whereby said plate, and said table, said bearing means, and said drive means are integrated into a single mechanical unit which does not tend to separate or spring apart responsive to forces applied for splitting said log.

2. A machine according to claim 1, in which said table is comprised of a plywood plate having an upper side which is covered in sheet metal.

3. A machine according to claim 1 or 2, in which a speed reducer means is provided between the drive means and a rotating shaft of the threaded cone, said speed reducer means comprising an intermediary pinion mounted on a bearing which is also fixed to said wedge.

4. A machine according to one of the claims 1 or 2, in which said plate has an upper profile which has substantially the same shape as a profile of the rotating threaded cone, up to a location which is a short distance back from the point of said cone.

5. A machine according to claim 1 in which said motor is an electric motor fastened under said table.

* * * * *